US006561071B1

(12) United States Patent
Norton et al.

(10) Patent No.: US 6,561,071 B1
(45) Date of Patent: May 13, 2003

(54) ELECTRONIC FIRING CIRCUIT TESTER FOR GUN MOUNT

(75) Inventors: John P. Norton, Waldorf, MD (US); Troy W. Ammons, Temple Hills, MD (US); Pablo Lopez, Waldorf, MD (US); Joseph J. Dulcey, Waldorf, MD (US); John A. Nial, Park Hall, MD (US); J. David DeLeon, Bell Alton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/430,291

(22) Filed: Oct. 29, 1999

Related U.S. Application Data

(60) Provisional application No. 60/106,227, filed on Oct. 30, 1998.

(51) Int. Cl.[7] ..... B64D 1/04; F41F 5/00

(52) U.S. Cl. ..... 89/1.1; 73/167

(58) Field of Search ..... 89/1.1, 135, 28.05, 89/28.2; 73/167; 102/472

(56) References Cited

U.S. PATENT DOCUMENTS

| | | | | | |
|---|---|---|---|---|---|
| 2,809,347 | A | * | 10/1957 | Bueter | 324/51 |
| 3,614,610 | A | * | 10/1971 | Legatti | 324/115 |
| 3,922,604 | A | * | 11/1975 | Thakore | 324/111 |
| 4,342,223 | A | * | 8/1982 | Smith | 73/167 |
| 4,363,105 | A | * | 12/1982 | Plassmeier | 364/580 |
| 4,777,864 | A | * | 10/1988 | Siech et al. | 89/45 |
| 4,857,826 | A | * | 8/1989 | Graham | 324/508 |
| 4,894,938 | A | * | 1/1990 | Davis | 42/1.01 |
| 5,109,200 | A | * | 4/1992 | Dushane et al. | 324/508 |
| 5,614,896 | A | * | 3/1997 | Monk et al. | 340/945 |
| 5,755,056 | A | * | 5/1998 | Danner et al. | 42/84 |
| 5,761,954 | A | * | 6/1998 | Dvorak | 73/167 |
| 5,813,278 | A | * | 9/1998 | Schabdach et al. | 73/167 |
| 6,067,851 | A | * | 5/2000 | Chaves et al. | 73/167 |

* cited by examiner

*Primary Examiner*—Michael J. Carone
*Assistant Examiner*—M. Thomson
(74) *Attorney, Agent, or Firm*—Mark Homer

(57) ABSTRACT

An electronic firing circuit tester (EFCT) that senses and indicates the status of electrical firing circuits for a gun. The EFCT requires no batteries or other maintenance and can display up to four tests of a gun's firing circuit.

9 Claims, 3 Drawing Sheets

ELECTRONIC FIRING CIRCUIT TESTER FOR GUN MOUNT

CROSS REFERENCE TO RELATED APPLICATION

This application claims benefit of priority under 35 U.S.C. section 119(e) of U.S. Provisional Application No. 60/106,227, filed Oct. 30, 1998, and entitled "ELECTRONIC FIRING CIRCUIT TESTER FOR GUN MOUNT".

BACKGROUND OF THE INVENTION

Large guns often use electric firing circuits to fire ordnance. These electric firing circuits must be tested to ensure that the circuit will apply the correct current and voltage to the ordnance primer. In order to test the firing circuits on guns it is necessary to load the gun with a test primer and then fire the weapon. If the primer explodes with an audible bang the firing circuit is good. This test must be repeated for each of the three or four firing control stations from which the gun may be fired in either the normal or emergency mode.

This method of testing does not provide feedback indicating whether the firing circuit is operating in the normal, alternating current (AC), mode or in the emergency, direct current (DC), mode. Additionally, for each test of the firing circuit the breech must be manually loaded with a primer test charge. Each time the breech is opened manually for the primer test fire there is a possibility of damage to the gun if the breech is opened before all the pressure is bled off. Also, due to the loud noise of the primer test firing numerous restrictions are placed on when and how test fires with primers may be conducted.

SUMMARY OF THE INVENTION

The present invention overcomes these deficiencies by replacing the old primer tester with an electronic tester. The electronic firing circuit tester (EFCT) is a microprocessor based tester. The tester requires no batteries as it draws the needed power directly from the firing pin of the gun to be tested. The EFCT is able to indicate whether the firing circuit was good or bad and whether the circuit was powered by AC or DC. After a short delay the EFCT will reset itself and may be reused.

The EFCT incorporates a microprocessor, or microcontroller, running embedded software with a unique method of calculating Root Mean Square (RMS). The software design allowed substantial processor memory space savings and increased speed over traditional software compiler RMS calculating functions.

Furthermore, the EFCT was designed so that it is capable of being loaded by automatic loaders that cycle the EFCT into position in the breech of the gun. The old primer based testing system required the primer to be manually loaded into the breech.

DETAILED DESCRIPTION OF THE PREFERRED EMBODIMENTS

Figure 1:
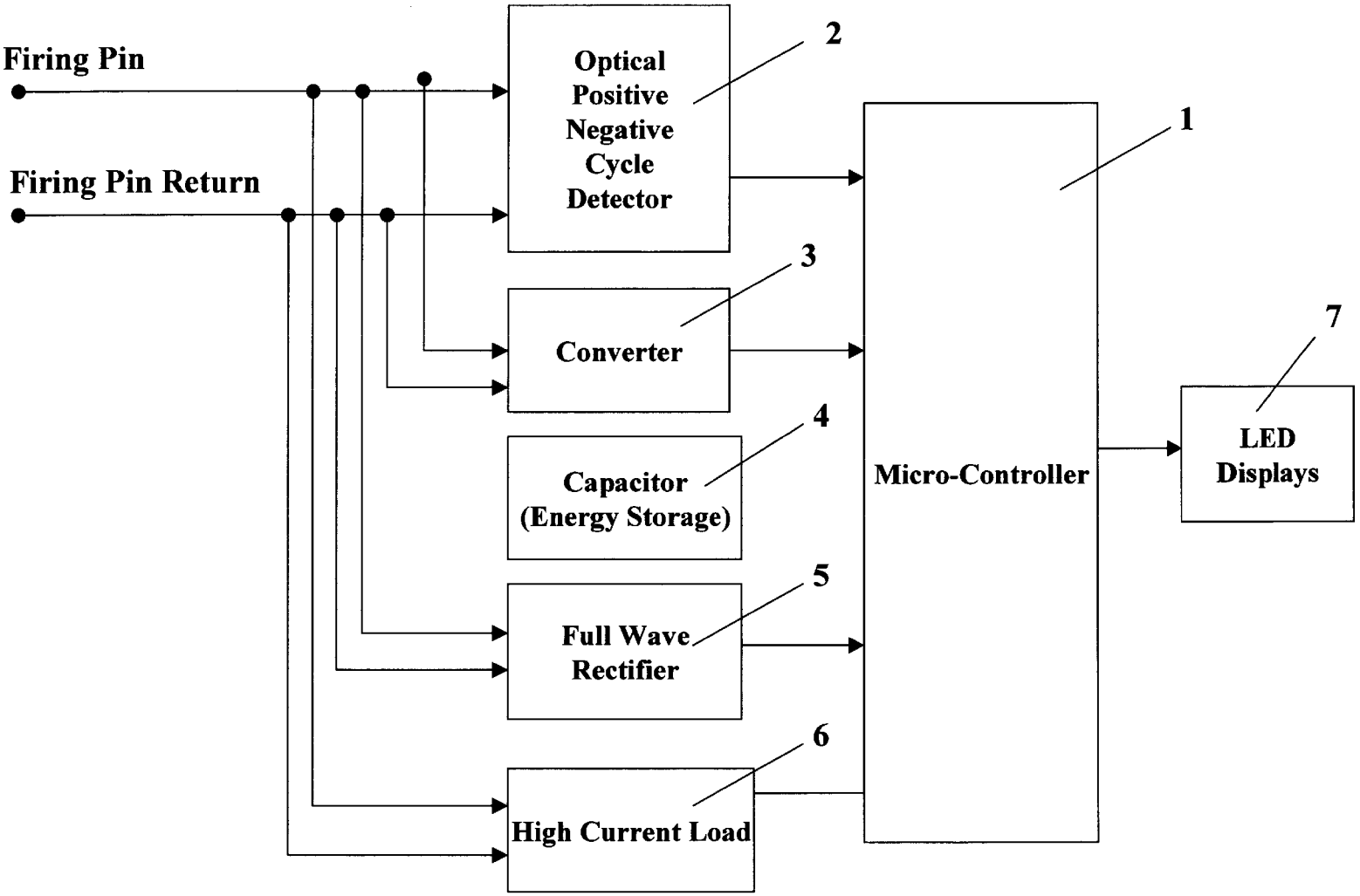
FIG. 1 is a block diagram of the electronic firing circuit tester (EFCT) device.

Referring now to the drawings, FIG. 1 shows a block diagram of the electronic firing circuit tester (EFCT), which includes a capacitor 4 that stores energy that is received each time the gun firing circuit is triggered. This energy is then used to power the microcontroller 1 and the LED display 7 through the DC Power Supply 3. The DC power supply 3 converts the energy stored in the capacitor 4 into 5 volt DC for the microcontroller 1 and LED display 7 in a manner well known in the art. The optical positive/negative cycle detector 2 provides the ability to detect the presence of AC or DC voltage at the gun's firing pin through the use of photodiodes. The high current load 6 is used in conjunction with the microcontroller 1 to send visual feedback to the gun's control panel (not shown) by causing a light on the external panel to blink twice if a good firing circuit is established and to blink once or not at all if the firing circuit is bad. The full wave rectifier 5 is used in conjunction with the optical positive/negative cycle detector 2 as input signals for the microcontroller 1 to determine RMS values for current and voltage received from the gun's firing pin.

Figure 2:
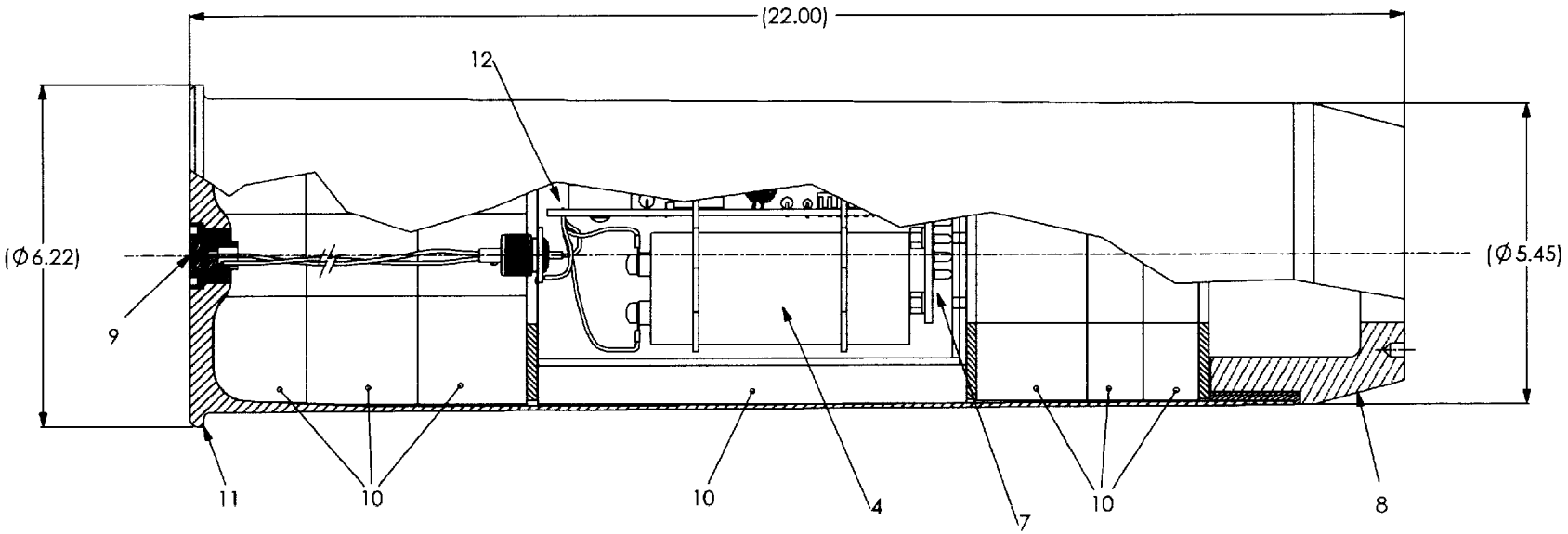
FIG. 2 is a side view with a partial cut out of the EFCT.

FIG. 2 shows the EFCT in its preferred package that approximates the length of a clearing charge shell for the gun. This side view with partial cut out reveals the general construction of the EFCT. The front end is a removable plug 8 made preferably out of high density polyethylene. This material was chosen to allow the EFCT to withstand the compression impact of hitting the breech as the EFCT is loaded into the gun and the tension impact of coming to a dead stop after being rammed into place. The EFCT is subjected to enormous g forces during this automatic loading cycle process of the gun. The voids inside of the shell casing 11 are filled with any suitable foam packing material 10 such as polyfoam to provide additional shock resistance. The electronics board assembly 12 is potted in standard potting compound to ensure that the components will not vibrate loose or be damaged in the gun loading cycle process. The LED display 7 was chosen because of the low power consumption and shock resistance of LEDs. The gun's firing pin mechanism serves as the input to the EFCT at the terminal electrode 9.

Figure 3:
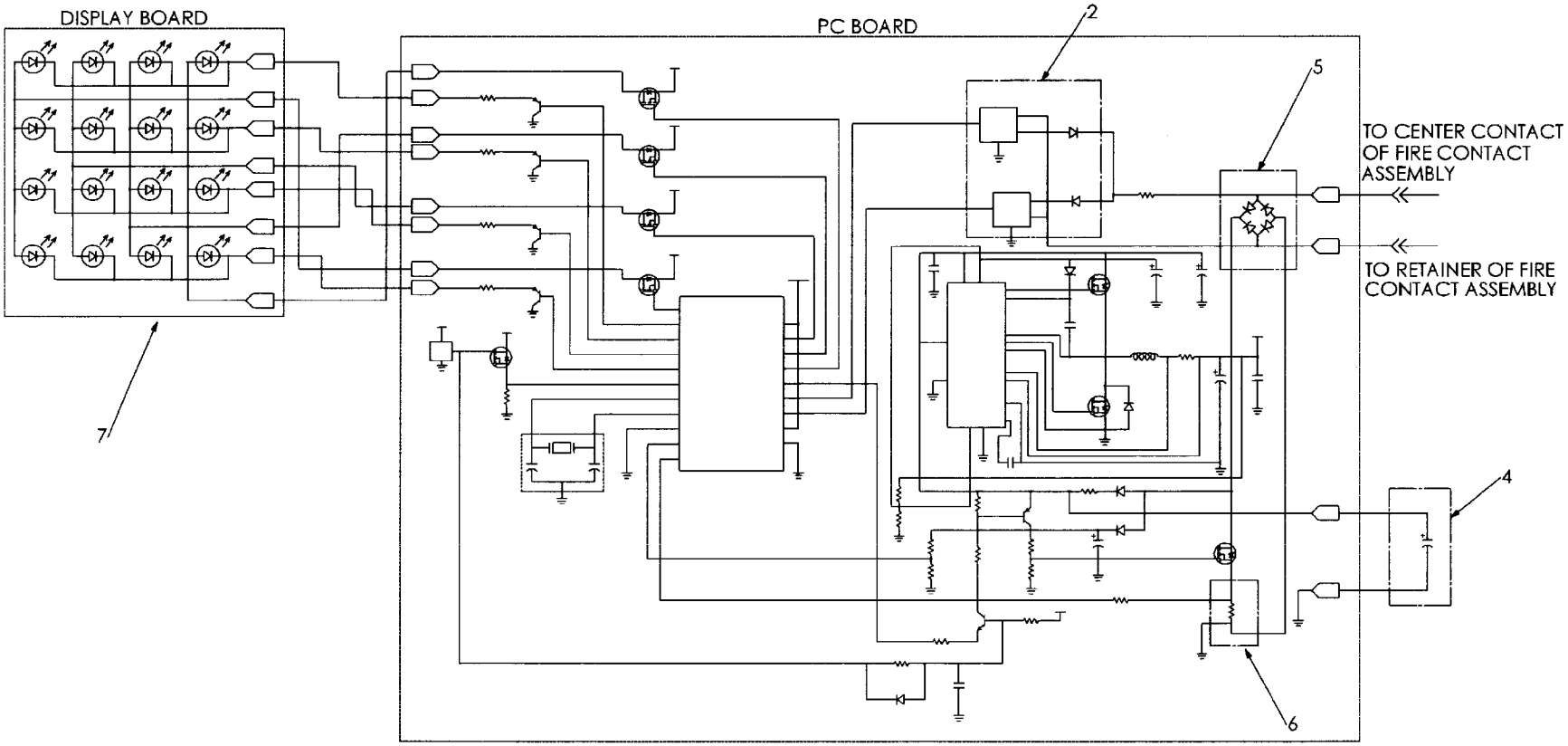
FIG. 3 is a schematic drawing of the EFCT device.

FIG. 3 is a detailed schematic of the EFCT invention. The EFCT employs a commercially available microcontroller with an EPROM, such as the Intel 87C752, 1 that gets inputs from which it calculates the voltage and current of the gun's firing circuit and generates output signals depending on the voltage and current level. The microcontroller 1 has a software program set into the EPROM of the chip that calculates the RMS values of the current and voltage of the gun's firing circuit and causes output signals to be developed that provide feedback to the user through the LED display 7 and at the gun's control panel (not shown). The EFCT stores energy from the gun's firing circuit in a large capacitor 4 so that no batteries are required to run the EFCT. The microcontroller is powered by a 5 volt DC power supply chip 3 that gets its voltage input from the energy stored by the capacitor 4. The EFCT senses AC or DC voltage from the gun's firing circuit through the optical positive/negative cycle detector 2. The microcontroller 1 measures the voltage supplied by the gun's firing control circuit by reading the voltage across the high current load 6. The microcontroller 1 drives outputs based on measured values that provide feedback to the user by the LED display 7 and by a light on the gun's control panel (not shown).

The operation of the EFCT will be further clarified through a hypothetical gun firing circuit test. The EFCT is placed in the loader and the EFCT is then cycled through the gun mount and loaded into the breech of the gun. At a gun control panel the fire command is given and the trigger is initiated causing a voltage to be developed across the gun's firing pin. The EFCT takes this energy from the firing pin and stores it in a capacitor 4. The microcontroller 1 samples input lines and calculates the voltage and current that was at the firing pin. If the voltage is less than 16 volts a bad circuit is indicated. To indicate a bad circuit, the microcontroller 1 will reduce the line voltage of the firing circuit once, causing the misfire light on the gun's control panel (not shown) to blink once or not at all if the voltage received was too low. If the voltage measured is greater than or equal to 16 volts then the current is measured. If the current is less than 10 amps a bad circuit is indicated as described above. If it is more than 10 amps a good circuit will be indicated. To indicate a good circuit, the microcontroller 1 reduces the line voltage of the firing circuit twice, causing the misfire light to blink twice on the gun's control panel (not shown).

Because of the need for almost real-time feedback the microcontroller 1 must process the values for voltage and current almost instantaneously and send the required output signals. This was accomplished by writing a software algorithm that works in the "square domain" to calculate RMS values for voltage and current. This program runs much faster and takes up much less memory space than traditional RMS calculating routines provided by commercial software compilers.

The microcontroller 1 also sends outputs to the LED display 7 which will display the results for up to four test fires. The LED display 7 is made up of a four by four matrix that is comprised of one column of green LEDs, one column of red LEDs, and two columns of yellow LEDs. The four columns of LEDs represent different conditions of the test fire: Go, No-Go, AC, and DC. The Go column is represented by the green LEDs and a lit LED will indicate that the proper voltage and current (16 V/10 amp) is being applied. If either the voltage or current is not within parameters (voltage less than 16 volts or current less than 10 amps) then a red LED will illuminate. For each test fire one LED in the first column of yellow LEDs will light if the current applied at the gun's firing pin was alternating current (AC). Likewise, one LED in the second column of yellow LEDs will light if the current applied at the gun's firing pin was direct current (DC). Each row of the LED display 7 represents the conditions for one test fire. The EFCT can record up to four test fires of the gun's firing circuit.

After the last test is run, the EFCT will go into a low power "sleep" mode that reduces power usage by approximately ninety percent. After a three-minute "sleep" delay, allowing the user to retrieve the EFCT, the EFCT will go to full power mode and light the LED display 7. The LED display 7 will remain illuminated for approximately 80 seconds. It is possible to extend the display time to three or four minutes by causing the LED display 7 to blink on for 0.3 seconds and off for 1.7 seconds. After the EFCT loses power it will reset and can be reused for more tests. The EFCT requires no maintenance.

All matter herein described and illustrated in the accompanying drawings does not disclose all possible variations of the invention. It would be obvious that numerous modifications can be made to the preferred embodiment described herein, without departing from the spirit of the invention. Though the invention is related specifically to 5"/54 caliber guns it may also be applied to other large military electric firing circuit guns.

We claim:

1. An electronic firing circuit tester for a gun, comprising:

a full wave rectifier that receives energy from an initiation of the firing circuit of a gun;

energy storage means that receives the energy from the full wave rectifier;

a power supply converter that converts the energy from the energy storage means into direct current;

a cycle detector connected to the firing circuit that detects the presence of alternating current or direct current at the firing circuit;

a microcontroller, powered solely by the direct current from the power supply converter, that receives input from the cycle detector wherein the microcontroller uses the input to determine root mean square values for current and voltage at the firing circuit; and, display means for indicating the root mean square values.

2. The electronic firing circuit tester of claim 1, wherein the energy storage means comprises a capacitor.

3. The electronic firing circuit tester of claim 2, further comprising means for displaying whether current at the firing circuit comprises alternating current or direct current.

4. The electronic firing circuit tester of claim 3, wherein the display means show whether the voltage or current exceeds predetermined thresholds.

5. The electronic firing circuit tester of claim 4, wherein the cycle detector uses photodiodes to detect the presence of alternating or direct current.

6. The electronic firing circuit tester of claim 5, further comprising a housing for the electronic firing circuit tester.

7. The electronic firing circuit tester of claim 6, wherein the electronic firing circuit tester may be automatically loaded into a breech of the gun.

8. The electronic firing circuit tester of claim 7, wherein the housing further comprises a shell casing and an end plug removably fixed to a distal end of the shell casing.

9. The electronic firing circuit tester of claim 8, further comprising means for resetting the electronic firing circuit tester after a predetermined amount of time.

* * * * *